US008839850B2

(12) United States Patent
Algeroy et al.

(10) Patent No.: US 8,839,850 B2
(45) Date of Patent: Sep. 23, 2014

(54) ACTIVE INTEGRATED COMPLETION INSTALLATION SYSTEM AND METHOD

(75) Inventors: John Algeroy, Houston, TX (US); Dinesh Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 372 days.

(21) Appl. No.: 12/897,043

(22) Filed: Oct. 4, 2010

(65) Prior Publication Data

US 2011/0079400 A1 Apr. 7, 2011

Related U.S. Application Data

(60) Provisional application No. 61/249,524, filed on Oct. 7, 2009.

(51) Int. Cl.
*E21B 47/12* (2012.01)

(52) U.S. Cl.
USPC ..... 166/65.1; 168/66; 175/40

(58) Field of Classification Search
USPC ..... 166/65.1, 66, 254.2; 175/26, 40; 340/853.3
See application file for complete search history.

(56) References Cited

U.S. PATENT DOCUMENTS

| | | | |
|---|---|---|---|
| 2,214,064 | A | 9/1940 | Niles |
| 2,379,800 | A | 7/1945 | Hare |
| 2,452,920 | A | 11/1948 | Gilbert |
| 2,470,303 | A | 5/1949 | Greenough |
| 2,782,365 | A | 2/1957 | Castel |
| 2,797,893 | A | 7/1957 | McCune et al. |
| 2,889,880 | A | 6/1959 | Hughes |
| 3,011,342 | A | 12/1961 | Simm |
| 3,199,592 | A | 8/1965 | Jacob |
| 3,206,537 | A | 9/1965 | Steward |
| 3,344,860 | A | 10/1967 | Voetter |
| 3,363,692 | A | 1/1968 | Bishop |
| 3,659,259 | A | 4/1972 | Chaney, Jr. et al. |
| 3,913,398 | A | 10/1975 | Curtis |
| 4,027,286 | A | 5/1977 | Marosko |
| 4,133,384 | A | 1/1979 | Allen et al. |
| 4,241,787 | A | 12/1980 | Price |
| 4,415,205 | A | 11/1983 | Rehm et al. |

(Continued)

FOREIGN PATENT DOCUMENTS

| | | | |
|---|---|---|---|
| EP | 795679 | A2 | 9/1997 |
| EP | 823534 | A1 | 2/1998 |

(Continued)

OTHER PUBLICATIONS

Brown, G.A., SPE 62952. "Using Fibre-Optic Distributed Temperature Measurements to Provide Real-Time Reservoir Surveillance Data on Wytch Farm Field Horizontal Extended-Reach Wells" Society of Petroleum Engineers Inc. 2000, pp. 1-11.

Saputelli, L. et al. "Real-Time Decision-making for Value Creation while Drilling" SPE/IADC Middle East Drilling Technology Conference & Exhibition, Oct. 2003.

(Continued)

*Primary Examiner* — Giovanna Wright
*Assistant Examiner* — Richard Alker
(74) *Attorney, Agent, or Firm* — David J. Groesbeck; Brandon S. Clark

(57) ABSTRACT

An installation system and method configured to install a lower completion section is provided. The installation system may comprise an installation drill pipe configured to releasably couple with a lower completion section. The installation system may comprise an electrical wet connect. The electrical wet connect may be coupled with a connector configured to establish a communication pathway between the electrical wet connect and components of the lower completion section. The lower completion section may be run in hole. Communications between a surface location and the lower completion components may be established via the electrical wet connect. The lower completion components may be tested prior to setting a lower completion section packer.

18 Claims, 2 Drawing Sheets

(56) References Cited

U.S. PATENT DOCUMENTS 4,484,628 A 11/1984 Lanmon, II
4,559,818 A 12/1985 Tsang et al.
4,573,541 A 3/1986 Josse et al.
4,597,290 A 7/1986 Bourdet et al.
4,733,729 A 3/1988 Copeland
4,806,928 A 2/1989 Veneruso
4,850,430 A 7/1989 Copeland et al.
4,901,069 A 2/1990 Veneruso
4,945,995 A 8/1990 Tholance et al.
4,953,636 A 9/1990 Mohn
4,969,523 A 11/1990 Martin et al.
5,183,110 A 2/1993 Logan et al.
5,269,377 A 12/1993 Martin
5,278,550 A 1/1994 Rhein-Knudsen et al.
5,301,760 A 4/1994 Graham
5,311,936 A 5/1994 McNair et al.
5,318,121 A 6/1994 Brockman et al.
5,318,122 A 6/1994 Murray et al.
5,322,127 A 6/1994 McNair et al.
5,325,924 A 7/1994 Bangert et al.
5,330,007 A 7/1994 Collins et al.
5,337,808 A 8/1994 Graham
5,353,876 A 10/1994 Curington et al.
5,388,648 A 2/1995 Jordan, Jr.
5,398,754 A 3/1995 Dinhoble
5,411,082 A 5/1995 Kennedy
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,457,988 A 10/1995 Delatorre
5,458,199 A 10/1995 Collins et al.
5,458,209 A 10/1995 Hayes et al.
5,462,120 A 10/1995 Gondouin
5,472,048 A 12/1995 Kennedy et al.
5,474,131 A 12/1995 Jordan, Jr. et al.
5,477,923 A 12/1995 Jordan, Jr. et al.
5,477,925 A 12/1995 Trahan et al.
5,499,680 A 3/1996 Walter et al.
5,520,252 A 5/1996 McNair
5,521,592 A 5/1996 Veneruso
5,533,573 A 7/1996 Jordan, Jr. et al.
5,542,472 A 8/1996 Pringle et al.
5,597,042 A 1/1997 Tubel et al.
5,655,602 A 8/1997 Collins
5,680,901 A 10/1997 Gardes
5,697,445 A 12/1997 Graham
5,706,896 A 1/1998 Tubel et al.
5,730,219 A 3/1998 Tubel et al.
5,823,263 A 10/1998 Morris et al.
5,831,156 A 11/1998 Mullins
5,871,047 A 2/1999 Spath et al.
5,871,052 A 2/1999 Benson et al.
5,875,847 A 3/1999 Forsyth
5,915,474 A 6/1999 Buytaert et al.
5,918,669 A 7/1999 Morris et al.
5,941,307 A 8/1999 Tubel
5,941,308 A 8/1999 Malone et al.
5,944,107 A 8/1999 Ohmer
5,944,108 A 8/1999 Baugh et al.
5,944,109 A 8/1999 Longbottom
5,945,923 A 8/1999 Soulier
5,954,134 A 9/1999 Longbottom
5,959,547 A 9/1999 Tubel et al.
5,960,873 A 10/1999 Alexander et al.
5,967,816 A 10/1999 Sampa et al.
5,971,072 A 10/1999 Huber et al.
5,975,204 A 11/1999 Tubel et al.
5,979,559 A 11/1999 Kennedy
5,992,519 A 11/1999 Ramakrishnan et al.
6,003,606 A 12/1999 Moore et al.
6,006,832 A 12/1999 Tubel et al.
6,035,937 A 3/2000 Gano et al.
6,046,685 A 4/2000 Tubel
6,061,000 A 5/2000 Edwards
6,065,209 A 5/2000 Gondouin
6,065,543 A 5/2000 Gano et al.
6,073,697 A 6/2000 Parlin et al.
6,076,046 A 6/2000 Vasudevan et al.
6,079,488 A 6/2000 Begg et al.
6,079,494 A 6/2000 Longbottom et al.
6,119,780 A 9/2000 Christmas
6,125,937 A 10/2000 Longbottom et al.
6,173,772 B1 1/2001 Vaynshteyn
6,173,788 B1 1/2001 Lembcke et al.
6,176,308 B1 1/2001 Pearson
6,176,312 B1 1/2001 Tubel et al.
6,192,980 B1 2/2001 Tubel et al.
6,192,988 B1 2/2001 Tubel
6,196,312 B1 3/2001 Collins et al.
6,209,648 B1 4/2001 Ohmer et al.
6,244,337 B1 6/2001 Cumming et al.
6,302,203 B1 10/2001 Rayssiguier et al.
6,305,469 B1 10/2001 Coenen et al.
6,310,559 B1 10/2001 Laborde et al.
6,318,469 B1 11/2001 Patel
6,328,111 B1 12/2001 Bearden et al.
6,349,770 B1 2/2002 Brooks et al.
6,354,378 B1 3/2002 Patel
6,360,820 B1 3/2002 Laborde et al.
6,374,913 B1 4/2002 Robbins et al.
6,378,610 B2 4/2002 Rayssiguier et al.
6,415,864 B1 7/2002 Ramakrishnan et al.
6,419,022 B1 7/2002 Jernigan et al.
6,457,522 B1 10/2002 Bangash et al.
6,481,494 B1 11/2002 Dusterhoft et al.
6,510,899 B1 1/2003 Sheiretov et al.
6,513,599 B1 2/2003 Bixenman et al.
6,515,592 B1 2/2003 Babour et al.
6,533,039 B2 3/2003 Rivas et al.
6,547,011 B2 * 4/2003 Kilgore ..... 166/387
6,568,469 B2 5/2003 Ohmer et al.
6,577,244 B1 6/2003 Clark et al.
6,588,507 B2 7/2003 Dusterhoft et al.
6,614,229 B1 9/2003 Clark et al.
6,614,716 B2 9/2003 Plona et al.
6,618,677 B1 9/2003 Brown
6,668,922 B2 12/2003 Ziauddin et al.
6,675,892 B2 1/2004 Kuchuk et al.
6,679,324 B2 1/2004 Den Boer et al.
6,695,052 B2 2/2004 Branstetter et al.
6,702,015 B2 3/2004 Fielder, III et al.
6,727,827 B1 4/2004 Edwards et al.
6,749,022 B1 6/2004 Fredd
6,751,556 B2 6/2004 Schroeder et al.
6,758,271 B1 7/2004 Smith
6,768,700 B2 7/2004 Veneruso et al.
6,776,256 B2 8/2004 Kostyuchenko et al.
6,787,758 B2 9/2004 Tubel et al.
6,789,621 B2 9/2004 Wetzel et al.
6,789,937 B2 9/2004 Haddad et al.
6,817,410 B2 11/2004 Wetzel et al.
6,828,547 B2 12/2004 Tubel et al.
6,837,310 B2 1/2005 Martin
6,842,700 B2 1/2005 Poe
6,845,819 B2 1/2005 Barrett et al.
6,848,510 B2 2/2005 Bixenman et al.
6,856,255 B2 2/2005 Chalitsios et al.
6,857,475 B2 2/2005 Johnson
6,863,127 B2 3/2005 Clark et al.
6,863,129 B2 3/2005 Ohmer et al.
6,864,801 B2 3/2005 Tabanou et al.
6,896,074 B2 5/2005 Cook et al.
6,903,660 B2 6/2005 Clark et al.
6,911,418 B2 6/2005 Frenier
6,913,083 B2 7/2005 Smith
6,920,395 B2 7/2005 Brown
6,942,033 B2 9/2005 Brooks et al.
6,950,034 B2 9/2005 Pacault et al.
6,975,243 B2 12/2005 Clark et al.
6,978,833 B2 12/2005 Salamitou et al.
6,980,940 B1 12/2005 Gurpinar et al.
6,983,796 B2 1/2006 Bayne et al.
6,989,764 B2 1/2006 Thomeer et al.

(56) References Cited

U.S. PATENT DOCUMENTS

| | | | | |
|---|---|---|---|---|
| 7,000,696 | B2 | 2/2006 | Harkins | |
| 7,000,697 | B2 | 2/2006 | Goode et al. | |
| 7,004,252 | B2 * | 2/2006 | Vise, Jr. | 166/250.01 |
| 7,007,756 | B2 | 3/2006 | Lerche et al. | |
| 7,040,402 | B2 | 5/2006 | Vercaemer | |
| 7,040,415 | B2 | 5/2006 | Boyle et al. | |
| 7,055,604 | B2 | 6/2006 | Jee et al. | |
| 7,063,143 | B2 | 6/2006 | Tilton et al. | |
| 7,079,952 | B2 | 7/2006 | Thomas et al. | |
| 7,083,452 | B2 | 8/2006 | Eriksson et al. | |
| 7,093,661 | B2 | 8/2006 | Olsen | |
| 7,712,524 | B2 | 5/2010 | Patel | |
| 7,735,555 | B2 | 6/2010 | Patel | |
| 7,775,275 | B2 | 8/2010 | Patel | |
| 7,866,414 | B2 | 1/2011 | Patel | |
| 7,878,249 | B2 | 2/2011 | Lovell | |
| 7,896,070 | B2 | 3/2011 | Lovell | |
| 7,896,079 | B2 | 3/2011 | Dyer | |
| 7,900,705 | B2 | 3/2011 | Patel | |
| 2001/0013410 | A1 | 8/2001 | Beck et al. | |
| 2002/0007948 | A1 | 1/2002 | Bayne et al. | |
| 2002/0050361 | A1 | 5/2002 | Shaw et al. | |
| 2002/0096333 | A1 | 7/2002 | Johnson et al. | |
| 2002/0112857 | A1 | 8/2002 | Ohmer et al. | |
| 2003/0137302 | A1 | 7/2003 | Clark et al. | |
| 2003/0137429 | A1 | 7/2003 | Clark et al. | |
| 2003/0141872 | A1 | 7/2003 | Clark et al. | |
| 2003/0150622 | A1 | 8/2003 | Patel et al. | |
| 2003/0221829 | A1 | 12/2003 | Patel et al. | |
| 2004/0010374 | A1 | 1/2004 | Raghuraman et al. | |
| 2004/0094303 | A1 | 5/2004 | Brockman et al. | |
| 2004/0164838 | A1 | 8/2004 | Hall et al. | |
| 2004/0173350 | A1 | 9/2004 | Wetzel et al. | |
| 2004/0173352 | A1 | 9/2004 | Mullen et al. | |
| 2004/0194950 | A1 | 10/2004 | Restarick et al. | |
| 2004/0238168 | A1 | 12/2004 | Echols | |
| 2005/0072564 | A1 | 4/2005 | Grigsby et al. | |
| 2005/0074210 | A1 | 4/2005 | Grigsby et al. | |
| 2005/0083064 | A1 | 4/2005 | Homan et al. | |
| 2005/0087368 | A1 | 4/2005 | Boyle et al. | |
| 2005/0092488 | A1 | 5/2005 | Rodet et al. | |
| 2005/0092501 | A1 | 5/2005 | Chavers et al. | |
| 2005/0115741 | A1 | 6/2005 | Terry et al. | |
| 2005/0149264 | A1 | 7/2005 | Tarvin et al. | |
| 2005/0168349 | A1 | 8/2005 | Huang et al. | |
| 2005/0178554 | A1 | 8/2005 | Hromas et al. | |
| 2005/0194150 | A1 | 9/2005 | Ringgenberg | |
| 2005/0199401 | A1 | 9/2005 | Patel et al. | |
| 2005/0236161 | A1 | 10/2005 | Gay et al. | |
| 2005/0274513 | A1 | 12/2005 | Schultz et al. | |
| 2005/0279510 | A1 | 12/2005 | Patel et al. | |
| 2006/0000604 | A1 | 1/2006 | Jenkins et al. | |
| 2006/0000618 | A1 | 1/2006 | Cho et al. | |
| 2006/0006656 | A1 | 1/2006 | Smedstad | |
| 2006/0016593 | A1 | 1/2006 | Gambier | |
| 2006/0042795 | A1 | 3/2006 | Richards | |
| 2006/0060352 | A1 | 3/2006 | Vidrine et al. | |
| 2006/0065444 | A1 | 3/2006 | Hall et al. | |
| 2006/0077757 | A1 | 4/2006 | Cox et al. | |
| 2006/0086498 | A1 | 4/2006 | Wetzel et al. | |
| 2006/0090892 | A1 | 5/2006 | Wetzel et al. | |
| 2006/0090893 | A1 | 5/2006 | Sheffield | |
| 2006/0124297 | A1 | 6/2006 | Ohmer | |
| 2006/0124318 | A1 | 6/2006 | Sheffield | |
| 2006/0162934 | A1 | 7/2006 | Shepler | |
| 2006/0196660 | A1 | 9/2006 | Patel | |
| 2006/0225926 | A1 | 10/2006 | Madhavan et al. | |
| 2006/0254767 | A1 | 11/2006 | Pabon et al. | |
| 2006/0283606 | A1 | 12/2006 | Partouche et al. | |
| 2007/0012436 | A1 | 1/2007 | Freyer | |
| 2007/0027245 | A1 | 2/2007 | Vaidya et al. | |
| 2007/0044964 | A1 | 3/2007 | Grigar et al. | |
| 2007/0059166 | A1 | 3/2007 | Sheth et al. | |
| 2007/0062710 | A1 | 3/2007 | Pelletier et al. | |
| 2007/0074872 | A1 | 4/2007 | Du et al. | |
| 2007/0107907 | A1 | 5/2007 | Smedstad et al. | |
| 2007/0110593 | A1 | 5/2007 | Sheth et al. | |
| 2007/0116560 | A1 | 5/2007 | Eslinger | |
| 2007/0142547 | A1 | 6/2007 | Vaidya et al. | |
| 2007/0144738 | A1 | 6/2007 | Sugiyama et al. | |
| 2007/0144746 | A1 | 6/2007 | Jonas | |
| 2007/0151724 | A1 | 7/2007 | Ohmer et al. | |
| 2007/0159351 | A1 | 7/2007 | Madhavan et al. | |
| 2007/0162235 | A1 | 7/2007 | Zhan et al. | |
| 2007/0165487 | A1 | 7/2007 | Nutt et al. | |
| 2007/0199696 | A1 | 8/2007 | Walford | |
| 2007/0213963 | A1 | 9/2007 | Jalali et al. | |
| 2007/0216415 | A1 | 9/2007 | Clark et al. | |
| 2007/0227727 | A1 | 10/2007 | Patel et al. | |
| 2007/0235185 | A1 | 10/2007 | Patel et al. | |
| 2007/0271077 | A1 | 11/2007 | Kosmala et al. | |
| 2007/0295504 | A1 * | 12/2007 | Patel | 166/263 |
| 2008/0236841 | A1 * | 10/2008 | Howlett et al. | 166/381 |
| 2009/0066535 | A1 | 3/2009 | Patel | |
| 2009/0151950 | A1 | 6/2009 | Patel | |
| 2010/0101786 | A1 | 4/2010 | Lovell | |
| 2010/0181067 | A1 | 7/2010 | Chen | |
| 2011/0011580 | A1 | 1/2011 | Clark | |
| 2011/0079400 | A1 | 4/2011 | Algeroy | |

FOREIGN PATENT DOCUMENTS

| | | | |
|---|---|---|---|
| EP | 1158138 | A2 | 11/2001 |
| EP | 0786578 | B1 | 12/2005 |
| GB | 2274864 | A | 8/1994 |
| GB | 2304764 | | 3/1997 |
| GB | 2333545 | A | 7/1999 |
| GB | 2337780 | A | 12/1999 |
| GB | 2345137 | A | 6/2000 |
| GB | 2360532 | A | 9/2001 |
| GB | 2364724 | A | 2/2002 |
| GB | 2376488 | A | 12/2002 |
| GB | 2381281 | A | 4/2003 |
| GB | 2392461 | A | 3/2004 |
| GB | 2395315 | A | 5/2004 |
| GB | 2395965 | A | 6/2004 |
| GB | 2401385 | A | 11/2004 |
| GB | 2401430 | A | 11/2004 |
| GB | 2401889 | A | 11/2004 |
| GB | 2404676 | A | 2/2005 |
| GB | 2407334 | A | 4/2005 |
| GB | 2408327 | A | 5/2005 |
| GB | 2409692 | A | 7/2005 |
| GB | 2416871 | A | 2/2006 |
| GB | 2419619 | A | 5/2006 |
| GB | 2419903 | | 5/2006 |
| GB | 2428787 | A | 2/2007 |
| RU | 2146759 | | 3/2000 |
| RU | 2171363 | | 7/2001 |
| WO | 199623953 | A1 | 8/1996 |
| WO | 9850680 | A2 | 11/1998 |
| WO | 9850680 | A3 | 11/1998 |
| WO | 9858151 | A1 | 12/1998 |
| WO | 9913195 | A1 | 3/1999 |
| WO | 0029713 | A2 | 5/2000 |
| WO | 0171155 | A1 | 9/2001 |
| WO | 200198632 | A1 | 12/2001 |
| WO | 03023185 | A1 | 3/2003 |
| WO | 2004076815 | A1 | 9/2004 |
| WO | 2004094961 | A1 | 11/2004 |
| WO | 2005035943 | A1 | 4/2005 |
| WO | 2005064116 | A1 | 7/2005 |
| WO | 2006010875 | A1 | 2/2006 |

OTHER PUBLICATIONS

Lanier et al. "Brunei Field Trial of a Fibre Optic Distributed Temperature Sensor (DTS) System in 1,DOOm Open Hole Horizontal Oil Producer" SPE 84324; SPE Annual Technical Conference and Exhibition, Oct. 5-8, 2003.

* cited by examiner

ACTIVE INTEGRATED COMPLETION INSTALLATION SYSTEM AND METHOD

TECHNICAL FIELD

The present invention relates generally to well completion installation systems, and more particularly to an installation and verification system for multi-zone intelligent completion systems. However, identification of an exemplary field is for the purpose of simplifying the detailed description and should not be construed as a limitation. Various embodiments of the concepts presented herein may be applied to a wide range of applications and fields as appropriate.

BACKGROUND

Hydrocarbon fluids such as oil and natural gas are obtained from a subterranean geologic formation, referred to as a reservoir, by drilling a well that penetrates the hydrocarbon-bearing formation. Once a wellbore is drilled, various forms of well completion components may be installed in order to control and enhance the efficiency of producing the various fluids from the reservoir. For example, in some cases an Active Integrated Completion (AIC) system may be installed into the wellbore in order to facilitate fluid production, such as when a long, horizontal lateral well bore which intersects numerous production zones is preferred. Several types of AIC systems are known, as described by Schlumberger's U.S. patent application Ser. No. 12/331,602, the contents of which are herein incorporated by reference in their entirety. However, problems may occur during the installation of a complex completion system such as the AIC system that could result in an increase in costs and rig time. Accordingly, there exists a need for methods and systems suitable to optimize the installation of AIC type completion systems.

SUMMARY OF THE INVENTION

Embodiments of the claimed invention may comprise an installation system configured to facilitate installation of and communication with a lower completion section, which may comprise numerous AIC systems. The installation system may comprise a drill pipe which is configured to releasably attach to the lower completion section, an electrical wet connect connector configured to communicate with a corresponding electrical wet connect run on a logging cable, and a power conduit configured to establish a power and communication pathway between the electrical wet connect and components of the lower completion section. The connection of the electrical wet connect run on the logging cable and the electrical wet connect connector provides a surface communication pathway, along the logging cable, between a surface location and the components of the lower completion section. In some cases, an inductive coupler may be provided to establish communication between the lower completion system and an installation drill pipe. As a result, a communication pathway may be established between the lower completion section and a point on the surface. This communication pathway may allow communication to the lower completion's AIC systems prior to the running in of the upper completion, or the setting of the lower completion packer.

Embodiments of the claimed invention may also comprise a method of installing a lower completion which includes attaching a lower completion section to an installation system. The lower completion section and installation system are run in hole. The installation system may comprise a drill pipe which is configured to releasably attach to the lower completion section, an electrical wet connect connector configured to communicate with a corresponding electrical wet connect run on a logging cable, and a power conduit configured to establish a power and communication pathway between the electrical wet connect and components of the lower completion section. A logging cable with an electrical wet connect is run through the drill pipe, and the electrical wet connect on the logging cable is connected with or to the electrical wet connect connector on the installation system. Power is provided to the lower completion section through the pathway provided by the logging cable, the electrical wet connect, the electrical wet connect connector, and the power conduit. Communication is established between a surface location and the lower completion section, also through the surface communication pathway provided by the logging cable, the electrical wet connect and the electrically wet connect connector, and the power conduit. At least one diagnostic or functional test is performed on the lower completion section, making use of the pathway to transmit the test data to the surface.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION OF THE INVENTION

In the following description, numerous details are set forth to provide an understanding of some illustrative embodiments of the present invention. However, it will be understood by those skilled in the art that various embodiments of the present invention may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the invention.

A lower completion section comprising at least one AIC system may be installed in a wellbore in order to provide an increased resolution inside of a reservoir, i.e., such as with an increased number of hydrocarbon producing zones covered in any given wellbore. In addition, the AIC system may allow for relatively increased efficiency and effectiveness in monitoring (e.g., pressure, temperature, flow rate, and water detection, among others) and control (e.g., electric, infinitely variable, among others). This monitoring and control may be achieved and communicated via an electric cable to the surface. The AIC system accomplishes this by isolating each zone with a packer element, and disposing a flow control valve within the isolated zone. Sensors and control lines (e.g. electric, fiber optic, or hydraulic) are also run throughout the AIC system, and communicate with the various elements in the zones. In some embodiments, the AIC system may not include flow control valves within the isolated zones. In these embodiments, sensors and control lines may still be present however, so that information relating to conditions within the isolated zones may still be collected and transmitted to the surface. In some embodiments, the lower completion may have upwards of fifteen such AIC systems, allowing for a greatly increased reservoir control over other conventional systems.

Figure 1:
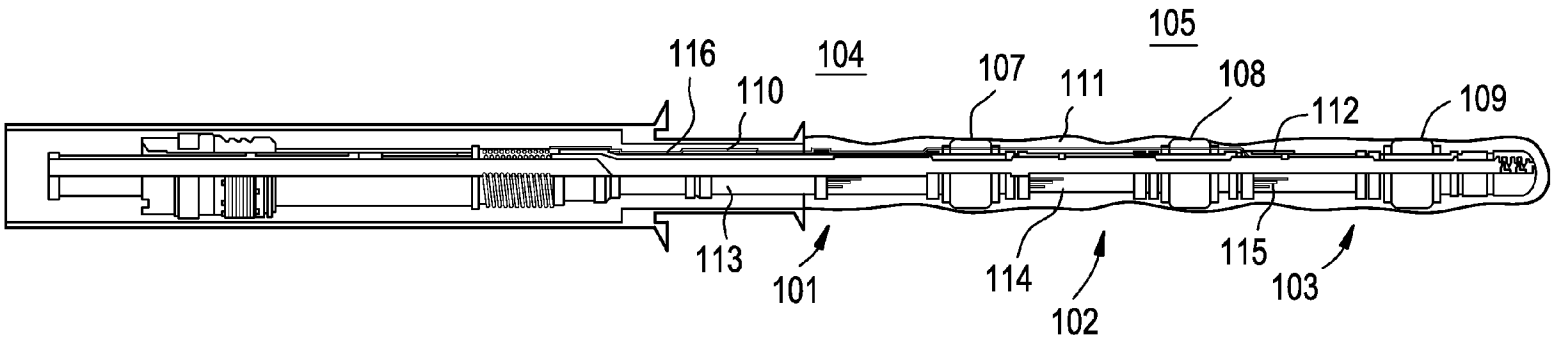
FIG. 1 is a schematic illustration of a lower completion section which comprises several active integration completion systems, as according to an embodiment of the invention.

An exemplary embodiment of some aspects of an AIC system is shown in FIG. 1. For sake of clarity, FIG. 1 shows a lower completion 100 with three AIC systems (101, 102, 103) each disposed within a production zone (104, 105, 106), but it is understood however that typical lower completions, according to various embodiments of the current invention, may comprise upwards of 15 such AIC systems, each disposed in a separate zone. Each AIC system (101, 102, 103) is isolated from another by a packer element (107, 108, 109) and each comprises a flow control device (110, 111, 112) (e.g. a flow control valve), which allows fluid to flow from the respective zone and into the lower completion section 100. In some embodiments the flow control device (110, 111, 112) may be solely electrically actuated, in some embodiments the flow control device (110, 111, 112) may be solely hydraulically actuated, and in other embodiments, the flow control device (110, 111, 112) may be both electrically and hydraulically actuated. Sensors (113, 114, 115), suitable to measure or detect at least one well parameter (e.g. pressure, temperature, pH, flow, etc) are also provided. In some embodiments the sensors (113, 114, 115) may be discrete sensors, and in other embodiments they may be distributed sensors. Communication and power is provided to sensors (113, 114, 115) and flow control devices (110, 111, 112) via control line 116. In some embodiments the control line 116 may be an electrical control line, in some embodiments the control line 116 may be a fiber optic control line, and in other embodiments the control line 116 may be a hybrid electric/fiber optic control line. When power is applied to the AIC systems 203, communication from the surface is possible in that signals through control line 116 may cause the flow control devices (110, 111, 112) to be actuated, or data may be transmitted from sensors (113, 114, 115) through control line 116.

In some embodiments, it may be possible to enhance a lower completion system with AIC systems by installing an inductive coupler or an upper completion to lower completion downhole electric, hydraulic, or fiber optic wet connect. Several types of inductive coupler systems are known, as described by Schlumberger's U.S. patent application Ser. No. 12/789,613, the contents of which are herein incorporated by reference in their entirety. The inductive coupler may allow for a split between an upper and lower completion, accordingly facilitating a more time efficient installation. In addition, the ability to split the completion may allow for effective future replacements of the upper completion. For example, the replacement of the upper completion could be required if a tubing leak has developed, or if a well operator needs to install or replace an electronic submersible pump (ESP), where the life expectancy typically is a lot less than the target life of any given well, among other situations. However, it should be noted that a lower completion with AIC systems can be installed without an inductive coupler or an upper completion to lower completion downhole electric, hydraulic, or fiber optic wet connect, e.g., by running tubing to surface and clamping an electric cable onto the tubing.

Use of an inductive coupler or an upper completion to lower completion downhole electric, hydraulic or fiber optic wet connect may allow for a lower completion section to be independently installed across a reservoir (i.e., not via an uninterrupted physical connection to a point at the surface of the well). One illustrative example of such a lower completion system may comprise one or more AIC systems (e.g., more than 15, in some cases, for example), an inductive coupler, and a production packer located near the top of the lower completion section. While the various AIC systems may be installed in the reservoir (e.g., such as in an open hole or in a perforated casing), the production packer may be installed inside of a cased section of the wellbore in order to ensure proper anchoring of the lower completion system.

Embodiments of an inductive coupler may create a magnetic field across two mating components without a direct physical connection. As a result, when applying electric power from the surface via an electric cable connected to an inductive coupler, communication (in the form of power and/or data) can be established with the sensors and valves installed below the inductive coupler. Connectivity between mating components for the inductive coupler may be applied through tubing. This type of connection allows for the transfer of power and data between the upper and lower completion sections, as well as to the surface (via an cable extending to the surface).

Embodiments of an upper completion to lower completion downhole electric wet connect may create a direct physical connection between two mating components, for instance, between an electric cable disposed on the upper completion and an electric cable disposed on the lower completion. As a result, when applying electric power from the surface via an electric cable connected to the upper completion portion, communication (in the form of power and/or data) can be established with the sensors and valves installed below the downhole electric wet connect, for instance, in the lower completion. This type of connection also allows for the transfer of power and data between the upper and lower completion sections, as well as to the surface (via a cable extending to the surface). An upper completion to lower completion downhole electric wet connect may also be used in conjunction with an upper completion to lower completion downhole hydraulic, or fiber optic wet connect.

Embodiments of an upper completion to lower completion downhole hydraulic wet connect may also create a direct physical connection between two mating components, for instance, between a hydraulic control line disposed on the upper completion and a hydraulic control line disposed on the lower completion. This connection allows a fluid communication path to be created between the upper completion, the lower completion, and the surface. As a result, a pressure differential (e.g. a pressure pulse) may be transmitted from the surface via the hydraulic control line to the lower completion elements installed below the downhole hydraulic wet connect, for instance, in the lower completion. This type of connection may be used to send a pressure signal to lower completion elements such as flow control valves. In response to such a signal, the flow control valve may perform an action, such as cycling or closing. An upper completion to lower completion downhole hydraulic wet connect may also be used in conjunction with an upper completion to lower completion downhole electric, or fiber optic wet connect.

Embodiments of an upper completion to lower completion downhole fiber optic wet connect may also create a direct physical connection between two mating components, for instance, between a fiber optic control line disposed on the upper completion and a fiber optic control line disposed on the lower completion. This connection allows a fiber optic communication path to be created between the upper completion, the lower completion, and the surface. As a result, a communication pathway may be formed from the surface via a fiber optic cable or control line connected to the upper completion portion, and communication in the form of data can be established with the sensors and valves installed below the downhole electric wet connect, for instance, in the lower completion. This type of connection may be used to create a distributed sensor along the fiber optic, or to send and receive data to/from discrete sensors disposed in the lower completion. This type of connection may also allow for data to be sent to lower completion elements such as flow control valves for purposes of instructing those elements to perform a task, such as cycle or close. An upper completion to lower completion downhole fiber optic wet connect may also be used in conjunction with an upper completion to lower completion downhole electric, or hydraulic wet connect.

During such an installation, the lower completion section may be made up and spaced out according to the reservoir data. A packer setting tool may be installed on the production packer in order to facilitate installation within the well via a drill pipe delivery system. Once the lower completion section is at the proper depth, a ball may be dropped and pumped as needed to a seat inside of the packer setting tool, and hydraulic pressure may then be applied from the surface through the drill pipe. Once a predetermined pressure is achieved within the drill pipe, the packer setting tool may actuate the packer, thereby locking and sealing the packer against an internal surface of the casing.

Following retrieval of the drill pipe and packer setting tool, the upper completion section may be installed. In some embodiments, an illustrative example of an upper completion section may comprise the following: an inductive coupler (i.e., an upper member configured to mate with the lower member in the lower completion section) or an upper completion to lower completion downhole electric, hydraulic, or fiber optic wet connect, a surface controlled sub-surface safety valve (SCSSV), or an electronic submersible pump (ESP), and tubing, among other components not expressly identified. The tubing may provide proper space-out to extend to the surface and for the inductive coupler components to engage, facilitating communication between the surface and the lower completion section.

However, one potential drawback to this configuration and installation method is that during other installations of the lower completion section on drill pipe, there is no communication link between the surface and the sensors and valves in the various lower completion AIC systems. This may be considered a high technical risk, as potential damage to individual components or electric cables may occur, especially with respect to the components installed in the open hole sections of the reservoir. In some cases, several days may pass from the time the lower completion AIC components (e.g. flow control valves, sensors, etc) are checked on surface until the upper completion section is landed and full connectivity to the AIC systems is established. As many of these systems are installed with packers comprising swellable elastomers, these packers may have swollen to an extent that they are fully engaged with corresponding open hole wall sections in the reservoir. Accordingly, the extent of engagement may prohibit retrieval of the lower completion section to the surface, should this be needed.

As a result, illustrative embodiments of the completion installation claimed herein may be configured to provide for communication between the lower completion system and the surface prior to a point in time from which retrieval may be too difficult to readily perform. For example, at least some of the various embodiments may allow for communication between AIC systems of the lower completion section and the surface prior to setting the packers of the lower completion section.

Figure 2:
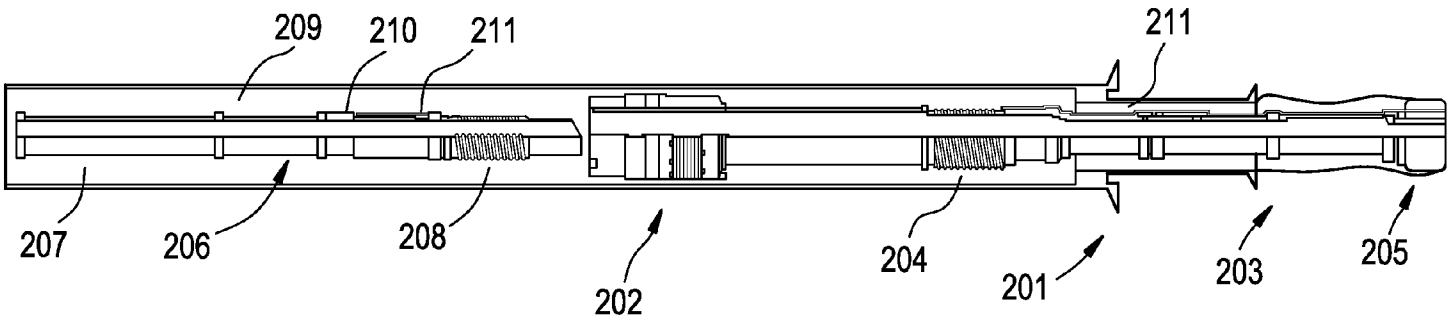
FIG. 2 is a schematic illustration of an installation system and a lower completion section, as according to an embodiment of the current invention.

An exemplary embodiment of some aspects of the present invention is shown in FIG. 2. While it is normally understood that lower completion section 201 would be made up or installed onto the installation system 206 at the surface, and that the lower completion section would then be run in and set downhole while the installation system 206 is installed within the lower completion section 201; for the ease of recognizing the various components of the installation system, FIG. 2 shows a view where the lower completion section 201 is separated from the installation system 206. In this figure, a lower completion section 201 with AIC systems 203 is shown run in hole, but without the lower completion packer 202 having been set. The lower completion section 201 comprises a female portion 204 of an inductive coupler. As mentioned, the AIC isolation packers 205 may begin to swell immediately, so it is preferable to test the various AIC components (e.g. sensors, flow control valves) to ensure that there was no damage during lower completion section 201 installation. Installation system 206 is provided, comprising a drill pipe 207, a male portion 208 of an inductive coupler (situated so as to properly mate with the female portion 204), and a packer setting tool 209, which is suitable to set the lower completion packer 202. Also provided on the drill pipe 207 is an electrical wet connect connector 210, which has attached power conduit 211 running between electrical wet connect connector 210 and the male portion 208 of the inductive coupler. The power conduit 211 may be physically disconnected across the inductive coupler sections (204, 208) as the inductive coupler itself serves to transfer power and communication between its male and female sections, thereby maintaining a power and communication path. Power conduit 211 continues from the female portion 204 of the inductive coupler and continues downhole to connect with the various other lower completion section 201 components (e.g. sensors, flow control valves, etc). Installation system 206 is run into lower completion section 201 until the various components such as the inductive couplers (204, 208) and packer setting tool/packer (209, 202) are properly aligned. Proper alignment of the installation tool 206 and the lower completion section 201 could result in numerous ways, for instance, through the design and spacing of the components on the systems, as would be known to one of skill in the art.

Figure 3:
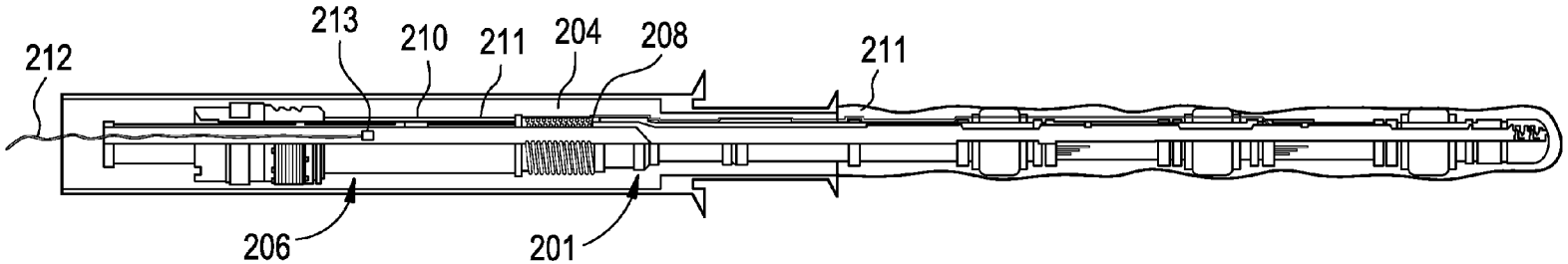
FIG. 3 is a schematic illustration of an installation system installed into a lower completion section, as according to an embodiment of the current invention.

FIG. 3 shows an exemplary embodiment of a lower completion 201 with installation system 206 fully installed. As seen, the male portion 208 of the inductive coupler disposed on the installation system 206 is aligned with the female portion 204 of the inductive couple disposed on the lower completion section 201, but at least initially after installation of the installation system 206 into lower completion section 201, there is no power provided to the inductive coupler assembly (204, 208), and therefore no power or communication is provided to the AIC systems 203. To provide power and communication to the surface, a logging cable 212 with an electric wet connect 213 is lowered into the well and pumped in place as required, for example, if the wellbore is highly deviated or horizontal. Once engaged with the corresponding opposing electric wet connect connector 210 provided in the installation system 206, power may be supplied via the logging cable 212 and electrical wet connect system (213, 210) to the various components of the lower completion section 201 (e.g. via power conduit 211). Likewise communication between the surface and the various systems in the lower completion 201, such as the AIC systems may be established, via a surface communication pathway created by the logging cable 212, the electrical wet connect system (213, 210), and in some cases, the power conduit 211.

In some embodiments, the electrical wet connect system (213, 210) may take the form of a tough logging condition (TLC) wet connect, such as the TLC Wet Connect provided by Schlumberger, which is further described in: U.S. Pat. No. 4,484,628; U.S. Pat. No. 5,871,052; U.S. Pat. No. 5,967,816; and U.S. Pat. No. 6,510,899, all the contents of which are herein incorporated by reference in their entirety. This form of wet connect technology may be used to allow communication and power to be supplied to the lower completion, via the logging cable. Typical tough logging conditions may comprise wells with high deviation or long horizontal sections where traditional logging activities with cable cannot be used.

In some embodiments, the electrical wet connect system (213, 210) may also include a hydraulic or fiber optic wet connect system. These systems may allow for the additional downhole connection of either hydraulic or fiber optic control lines, so as to allow fiber optic or hydraulic communication to be supplied to the lower completion, via the logging cable, or a control line cable disposed in a similar manner. In these embodiments, both an electric and hydraulic or fiber optic connection may be temporarily made between the surface, and the lower completion section 201 so as to establish a power and communication pathway between the surface and the lower completion section 201. In some embodiments, the wet connect system may not be an electrical wet connect system as shown and described, but may be a solely fiber optic, or hydraulic (or combination fiber optic and hydraulic) wet connect system. In these embodiments, connection may be made as described above between the surface and the lower completion via cable or control line which is pumped downhole. This non-electrical wet connect system would allow for the temporary hydraulic or fiber optic connection between the surface and the lower completion section, so as to establish a power and communication pathway between the surface and the lower completion section.

Once power and communication are established with the lower completion section 201, this communication may facilitate a full system (e.g. all the various AIC systems) or partial system (e.g. at least one AIC system component) functionality or diagnostic check, such as operating of the various flow control valve(s), recording of well data from the sensors, etc. Data from the AIC sensors is transmitted through the lower completion section 201, through the electrical wet connect system (213, 210), and through the logging cable 212 to the surface. Furthermore the flow control valves may be used at this point as circulation devices should there be a need for displacing the well fluids prior to setting the lower completion packer 202. The data transferred to the surface (not shown) may be interpreted in a conventional way, for instance through the use of a computer processor, to determine if the various lower completion section 201 components are functioning properly. In some embodiments, each component in the lower completion section 201 which is capable of being tested is tested to determine if the component is functioning properly. Non-limiting examples of an improperly functioning component include be a flow control device which fails to open or close, or a sensor which fails to transmit a signal.

In case of any fault in the system (e.g. an improperly functioning component), the lower completion section 201 may be retrieved to surface prior to setting the lower completion packer 202, which greatly simplifies the retrieval process and significantly reduce rig time and costs (as opposed to a work over or retrieval after the lower completion packer 202 has been set, or the upper completion section installed). To remove the lower completion sections 201, the electrical wet connect system (213, 210) is disconnected such that the electrical wet connect 210 is disconnected or decoupled from the electrical wet connect connector 210. The logging cable 212 and electrical wet connect 210 may then be retrieved and taken to the surface. The installation system 206 may then be removed, and taken to the surface together with the lower completion section 201, where the improperly functioning component may be repaired or replaced. Removal of the installation system 206 and the lower completion section 201 may be done in a conventional manner, as known to one of skill in the art.

If the functionality or diagnostic tests discovers no fault, and if it is determined that the lower completion 201 systems are appropriately functioning at depth, the electrical wet connect 213 may be disconnected from the electrical wet connect connector 210, and the logging cable 212 and electrical wet connect 213 may be retrieved to surface. The lower completion packer 203 may then be set.

In some embodiments, the lower completion packer 203 may be set in different ways. Packer setting tools come in many different sizes and configurations. With regard to an installation system, one consideration may be to use a hydraulic set retrievable packer. However, alternative packer designs requiring different setting methods may be used, as described above. The packer setting tool may be installed in a drill pipe delivery system. In some embodiments, a ball may be dropped inside of the drill pipe, engage a seat in the packer setting tool, and create a differential pressure when hydraulic pressure is applied in the drill pipe from the surface. In some embodiments, differential pressure may be achieved by closing all the lower completion flow control valves and pressuring up the interior of the drill pipe. The pressure may actuate a set of pistons in the packer setting tool, which in turn may act on the packer. Accordingly, the packer may engage a set of slips, thereby securing the packer to the casing and compressing a sealing element to create a substantially pressure tight seal against the casing.

In some embodiments, when a setting tool may be used to set the packer, the packer may be a Schlumberger Quantum Max packer. In some embodiments, when the packer may not require a setting tool, the packer may be a case of swell or reactive material packer, or a packer with a built in setting piston, such as with Schlumberger XHP packers.

After the setting of the lower completion packer 203, the installation system 206 may then be uncoupled from the lower completion section 201 and retrieved per standard procedure. After retrieval of the installation system 206, run in of the upper completion section can be performed.

Some embodiments of lower completion section installation method may be used for system verification prior to setting the lower completion section packer in wellbores that are vertical, deviated, horizontal, or multi-lateral. In some situations, alternative embodiments may comprise an electric wet connection or any other type of connection that is configured to transmit data and/or power in place of the described inductive coupler connection.

While the invention has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the invention.

What is claimed is:

1. An installation system comprising:

a lower completion section;

a drill pipe configured to releasably attach to the lower completion section;

an electrical wet connect connector configured to communicate with a corresponding electrical wet connect run on logging cable;

a power conduit configured to establish a communication pathway between the electrical wet connect and components of the lower completion section;

an inductive coupler having a male portion disposed on the drill pipe and a female portion disposed in the lower completion section; and wherein connection of the corresponding electrical wet connect run on logging cable and the electrical wet connect connector provides a surface communication pathway, along the logging cable, between a surface location and the components of the lower completion section, and wherein the surface communication pathway is established when an upper completion is not installed.

2. The installation system of claim 1, wherein the lower completion comprises an active integration completion system, the active integrated completion system comprising: at least one sensor; at least one flow control device; and at least one packer element.

3. The installation system of claim 1, wherein the lower completion comprises an active integration completion system, the active integrated completion system comprising a plurality of sensors.

4. The installation system of claim 1, wherein the lower completion section comprises a minimum of 15 active integrated completion systems.

5. The installation system of claim 1, wherein the electrical wet connect and the electrical wet connect connector comprise a tough logging condition (TLC) type wet connect system.

6. The installation system of claim 1, wherein the lower completion section comprises: a lower completion packer suitable to support the lower completion section and separate the lower completion section from an upper completion; and the drill pipe comprises a packer setting tool suitable to set the lower completion packer.

7. An installation system comprising:

a lower completion section;

a drill pipe configured to releasably attach to the lower completion section;

an electrical wet connect connector configured to communicate with a corresponding electrical wet connect run on logging cable;

a power conduit configured to establish a communication pathway between the electrical wet connect and components of the lower completion section; and wherein connection of the corresponding electrical wet connect run on logging cable and the electrical wet connect connector provides a surface communication pathway, along the logging cable, between a surface location and the components of the lower completion section, and wherein the surface communication pathway is established when an upper completion is not installed, wherein the electrical wet connect and the electrical wet connect connector further comprise a hydraulic or a fiber optic wet connect system.

8. A method for installing a lower completion section, comprising:

installing the lower completion section down hole, wherein the lower completion section is disposed on an installation system, wherein the installation system comprises:

a drill pipe configured to releasably attach to the lower completion section;

an electrical wet connect connector configured to communicate with a corresponding electrical wet connect run on logging cable; and a power conduit configured to establish a power and communication pathway between the electrical wet connect and components of the lower completion section;

running the logging cable with an electrical wet connect through the drill pipe;

connecting the electrical wet connect on the logging cable with the electrical wet connect connector on the installation system;

providing power to the lower completion section through a pathway provided by the logging cable, the electrical wet connect, the electrical wet connect connector and the power conduit;

establishing communication between a surface location and the lower completion section through the pathway; and performing at least one diagnostic test on the lower completion section before installing an upper completion.

9. The method of claim 8, wherein the lower completion section comprises at least one active integrated completion system, the active integrated completion comprising: at least one sensor; at least one flow control device; and at least one packer element.

10. The method of claim 8, wherein the lower completion section comprises at least one active integrated completion system, the active integrated completion system comprising a plurality of sensors.

11. The method of claim 8, wherein the lower completion section comprises at least 15 active integration completion systems.

12. The method of claim 9, wherein performing at least one diagnostic test comprises either obtaining a sensor reading from one of the active integrated completion sensors or actuating one of the active integrated completion flow control devices.

13. The method of claim 8, further comprising providing an inductive coupler, wherein a female section of the inductive coupler is disposed on the lower completion section, and a male section of the inductive coupler is disposed on the installation tool.

14. The method of claim 13, wherein providing power to the lower completion section further comprises providing power to the inductive coupler, wherein the power conduit is disposed between the electrical wet connect connector and the female section of the inductive coupler so as to provide power to the female section.

15. The method of claim 8, further comprising:

disconnecting the electrical wet connect from the electrical wet connect connector;

retrieving the logging cable and electrical wet connect;

setting a lower completion section packer; and retrieving the installation system.

16. The method of claim 8, further comprising:

receiving at least one result from the diagnostic test indicating that at least part of the lower completion section is not functioning properly;

disconnecting the electrical wet connect from the electrical wet connect connector;

retrieving the logging cable and electrical wet connect;

retrieving the installation system; and removing the lower completion section from down hole.

17. The method of claim 8, wherein the electrical wet connect system comprises a tough logging condition (TLC) type system.

18. The method of claim 8, wherein the electrical wet connect and the electrical wet connect connector further comprise a hydraulic or a fiber optic wet connect system.

* * * * *